United States Patent [19]

Camarota

[11] Patent Number: 5,026,010

[45] Date of Patent: Jun. 25, 1991

[54] LATCHED DETACHABLE LEG ASSEMBLY

[75] Inventor: Richard J. Camarota, Holland, Mich.

[73] Assignee: ITC Incorporated, Zeeland, Mich.

[21] Appl. No.: 518,917

[22] Filed: May 4, 1990

[51] Int. Cl.[5] ..... F16M 11/20

[52] U.S. Cl. ..... 248/188.1; 248/188.7; 108/150

[58] Field of Search ..... 248/188.1, 188.7, 158, 248/159; 108/150

[56] References Cited

U.S. PATENT DOCUMENTS

| | | | |
|---|---|---|---|
| 1,631,227 | 6/1927 | See | 248/188.1 X |
| 1,937,998 | 12/1933 | Uhl | 248/188.7 |
| 2,168,810 | 8/1939 | Sheldrick | 248/188.1 |
| 2,364,794 | 12/1944 | Koch | 248/158 |
| 2,464,300 | 3/1949 | Fox | 248/188.1 |
| 2,746,705 | 5/1956 | McKinley | 248/188.7 |
| 3,327,656 | 6/1967 | Schwartz | 108/150 |
| 3,391,660 | 7/1968 | Stewart | 108/150 X |
| 4,574,709 | 3/1986 | Lackey et al. | 108/150 X |
| 4,598,892 | 7/1986 | Franckowiak et al. | 248/188.7 X |
| 4,756,496 | 7/1988 | Hogan et al. | 108/150 X |
| 4,925,140 | 5/1990 | Camarota | 248/188 |

*Primary Examiner*—Gary L. Smith
*Assistant Examiner*—Suzanne L. Dino

[57] ABSTRACT

A support for a table top or the like is provided by a leg having end portions over and to each of which is mounted a sleeve of a material characterized by a frus-to-conical exterior surface and a high coefficient of friction. Each sleeved end of the leg is designed to seat in and tightly and frictionally engage one of the sockets to provide rigid support for the table top and each sleeve is provided with a releasable latch to prevent separation of the leg from the socket in the absence of intentional detachment of the latch by an operator.

8 Claims, 2 Drawing Sheets

LATCHED DETACHABLE LEG ASSEMBLY

FIELD OF THE INVENTION

This invention relates to the support assembly disclosed in my co-pending U.S. Pat. application Ser. No. 325,989, filed Mar. 20, 1989, now U.S. Pat. No. 4,925,140, entitled "DETACHABLE LEG ASSEMBLY". This invention provides a positive latch means to prevent detachment of the leg, unless the latch is released by the user.

BACKGROUND OF THE INVENTION

The invention is particularly intended for use in connection with furniture designed to be stored when not in use. To conserve storage space, it is very desirable that furniture used for this purpose be capable of being folded or disassembled so it can be rendered as compact as possible for storage. Further, the steps necessary to assemble or disassemble the furniture should be both simple and quickly completed. This is accomplished by the construction disclosed in my earlier application, Ser. No. 325,989.

However, it has been discovered that for certain applications, such as in motor homes, it is considered essential that means be provided to positively lock the furniture to the vehicle body so that, in the absence of an intentional act by an operator, the leg on which the furniture is supported will not become detached from the vehicle structure, such as a floor. Also, the invention provides such a means which can also be utilized to prevent unintentional detachment of the leg from that which it is supporting, such as a table top. The invention does not require the table top to have any particular circumferential position with respect to the leg. Thus, it does not restrict or interfere with the positioning of non-circular table tops in the most useable position.

BRIEF SUMMARY OF THE INVENTION

The invention provides a latch integral with the sleeve used to secure the leg to either the floor or the top. The openings in the socket through which the latch extends when the leg and socket are assembled are of such circumferential length that an effective lock between the leg and the socket forming bracket can be effected irrespective of the circumferential position of the leg with respect to the socket.

DESCRIPTION OF THE PREFERRED EMBODIMENT

Figure 1:
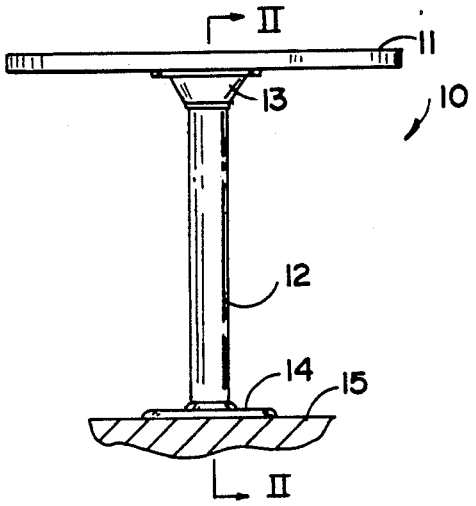
FIG. 1 is an elevational view of a table equipped with this invention.

Referring to FIG. 1, there is illustrated a single pedestal table 10 incorporating this invention. The table has a top 11 and a leg 12. An upper bracket 13 provides a means for connecting the leg 12 to the table top 11. A lower bracket 14 provides a means for connecting the leg 12 to a supporting surface such as a floor or a deck 15.

Figure 3:
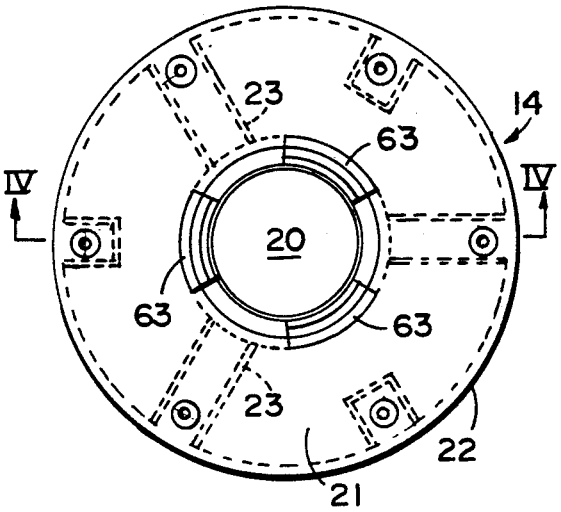
FIG. 3 is a plan view of the bracket for securing the leg to the floor.

The lower bracket 14 has a central socket 20 integral with and surrounded by a flange 21. The flange is illustrated as circular but could be rectangular or oval, for example, without affecting this invention. The flange is illustrated as having a peripheral downwardly curved lip 22 connected to the central socket 20 by radially extending ribs 23 (FIG. 3). These ribs reinforce flange 21. However, they can be omitted or other structure substituted since these ribs, as such, are not part of this invention. The juncture between the socket and the flange is preferably strengthened by the reinforcements 24 since all of the load imposed by the table must be transmitted from the socket walls to the flange 21. The lower bracket is secured to the floor by suitable means such as screws 28.

Figure 2:
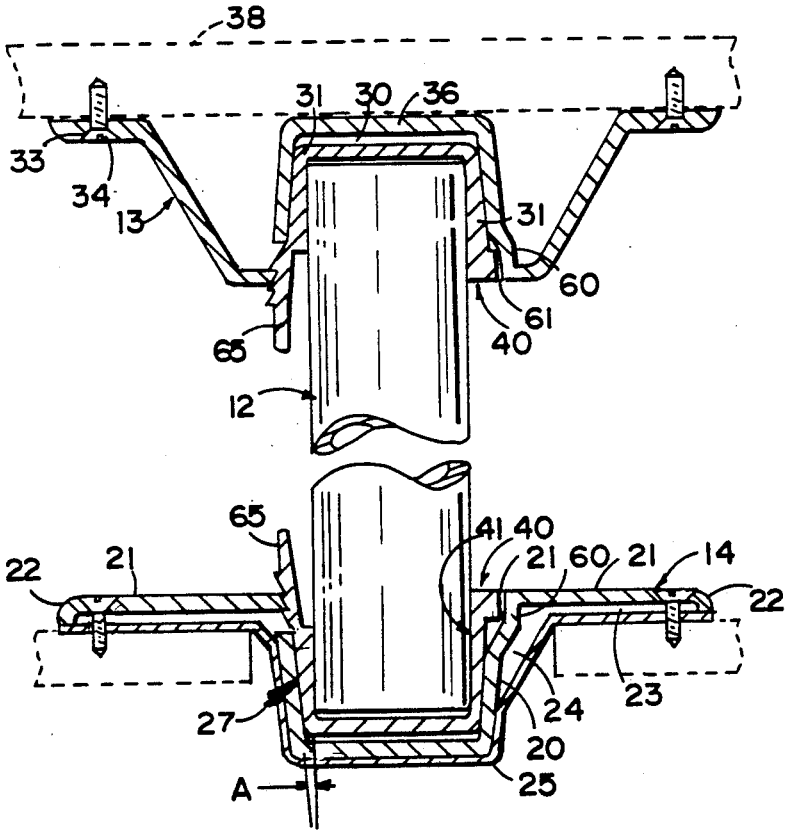
FIG. 2 is an enlarged, fragmentary, sectional view taken along the plane II—II of FIG. 1.

The socket 20 is a downwardly extending receptacle of about 2 to 3 inches in depth to receive the lower end of the leg 12. The inside walls 27 of the socket are tapered, providing the socket with a downwardly decreasing diameter. The taper A is preferably 2° to the socket's central axis B (FIG. 2). The walls of the socket are preferably smooth as would be the case with a die cast part and the end is closed by the web 25. The closure of the end braces the walls of the socket against loads imposed on them by the table or seat or other load bearing structure supported by the leg.

The upper bracket 13 is similar in size to the lower bracket 14, having a central socket 30 which is recessed upwardly into a central collar 31 which joins the socket to the peripheral flange 32. Preferably, the upper end of the socket 30 is closed by the web 36. The flange has openings 33 for fasteners such as screws 34 to anchor the bracket 13 to the object, such as a table top or chair seat 38, which it is to support.

Figure 8:
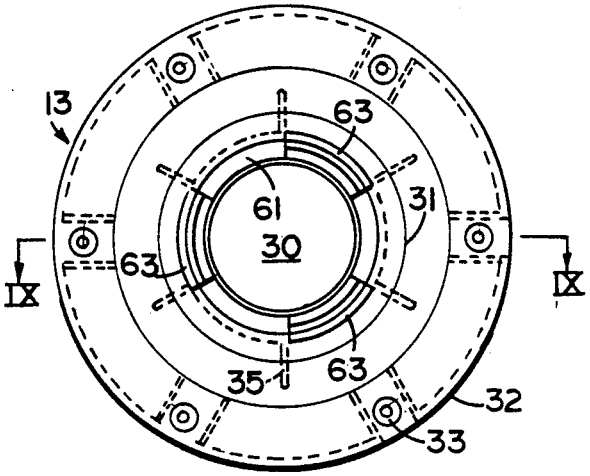
FIG. 8 is a bottom view of the leg anchoring bracket which is secured to the supported surface.
Figure 9:
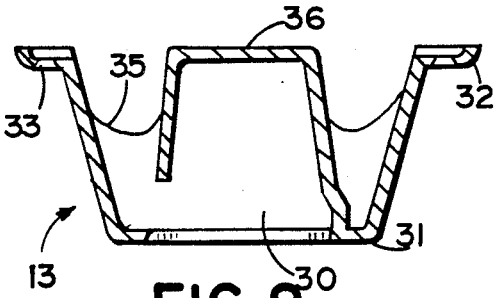
FIG. 9 is a sectional view taken along the plane IX—IX of FIG. 8.

The central socket 30 is identical in size and shape to the socket 20 including the 2° taper of the socket walls. The walls of the socket are reinforced by ribs 35 (FIGS. 8 and 9).

Both the upper and the lower brackets can be aluminum die cast parts. Die casting is particularly desirable because it permits the casting to be reproduced in quantity to close tolerances, particularly that of the taper and dimensions of the sockets without machining. Also, it permits the sockets to be produced with very uniform and accurate tapers, which accuracy, as will be explained subsequently, is important to the functionality of this invention. Also, the surface of the socket can be cast with a smooth finish which is another characteristic important to this invention.

The leg 12 is a tubular member, preferably of steel because of carbon steel's lower cost as compared to aluminum or stainless steel. Because the taper which is essential to the functionality of this invention is provided by the sockets 20 and 30 and the sleeves 40, the leg can be of uniform inner and outer diameter throughout its length. Therefore, it can be fabricated simply by cutting it to length from suitable stock, such as, for example, 2 inch diameter 0.035 inch wall, steel pipe stock. It is also possible to utilize fiberglass reinforced plastic tubing of the same diameter for the leg.

The leg 12 has been described as of uniform shape and cross section throughout its length, this is obviously the most desirable design from the standpoint of simplicity, cost and pure functionality. However, it will be recognized that the necessity for the circular cross section of uniform diameter is only necessary at the ends of the leg over which the sleeves 40 are mounted. That portion of the legs between the sleeves can be of any of a number of cross-sectional shapes and may be of a cross-sectional size greater or smaller than the ends. In fact, lengthwise, the leg could have a laterally extending portion whereby the upper and lower portions of the leg are laterally offset from each other. This arrangement could be advantageous in a bus or motor home between seats so that the base of the leg, for example, is adjacent the side wall with the table extending over an obstruction free area beneath the table for people sitting at the table to place their feet.

Each end of the leg is capped with a jacket or sleeve 40. The sleeves are identical and each has an interior opening 41 of uniform diameter throughout whereby it will closely fit around the end of the leg. The length of the sleeve is slightly more or less than the depth of the socket. The sleeve is bonded to the leg by a suitable adhesive, the choice of which will depend upon the plastic from which the sleeve is cast. It is necessary that the sleeve have at least some degree of surface lubricity to permit attachment and detachment of the leg from the end brackets. Polypropylene has been found to be a suitable material from which to mold the sleeve. Other materials considered to be suitable for the sleeve are nylon and acrylonitrile-butadiene styrene (ABS). In the case of polypropylene, a suitable adhesive is epoxy and for nylon it could be a polyamide and for ABS an acrylic.

The density of the material of the sleeve is important because when the end of the leg is fully seated in the socket, the sleeve must be substantially incompressible. To accomplish this, it is necessary this condition be attained before the end of the leg and sleeve bottom in the socket. Thus, as the leg is inserted into the bracket socket, whatever compressibility the material has must be overcome sufficiently that under the operating loads imposed on the object to be supported, the sleeve will act as if it were incompressible. Failure to do this will result in the leg being capable of some degree of rock or wobble, adversely affecting the functionally of the supported object. At the same time, the ability to separate the sleeve and bracket with the use of rotational or axially applied force of the type the average person can apply without tools must be maintained. It is for this reason that a certain degree of surface lubricity is necessary to initiate separation when desired.

It is necessary to cast the sleeves because, while having a constant internal diameter, the outer face 43 is uniformly tapered with the least diameter being adjacent the closed end of the tube. This taper, indicated by the letter C in FIG. 2, is preferably 2° to the sleeve's inside surface which is parallel to the sleeve's central axis B. The taper has to be the same as that of the inside surface 27 of the socket into which it is fitted which is indicated by the angle A in FIG. 2. The end 45 of the sleeve which seats over the end of the tube closes the end of the tube. If the same sleeve is used at both ends of the leg, the interior of the leg becomes a sealed chamber. It has also been found necessary to provide pressure relief for gas trapped in the leg since the pressure differential between the interior and exterior of the tube can change significantly due to changes in both temperature and barometric pressure. This can be accomplished by providing a 1/16 inch diameter hole in the center of the end web of the socket and the leg bracket or by a hole somewhere else in the leg.

The portion of the exterior surface of the tube not covered by the sleeves can be protected by plating or powder coating. If the tube is aluminum, it will not require this treatment. If the tube is steel, the presence of the sleeves at both ends seals the tube preventing moisture from entering the tube to cause rust of the interior surface. The functionality of the sleeves to prevent the entrance of moisture is not impaired by providing the small pressure relief opening.

The depth of the sockets 20 and 30 must be sufficient for a positive, non-rockable interlock between the leg and the brackets. A socket having a depth of 2–2 ½ inches has been found to be satisfactory. The sleeve may be somewhat longer than the socket so that a small portion of it projects beyond the end of the socket, when the end of the leg is fully seated.

Figure 4:
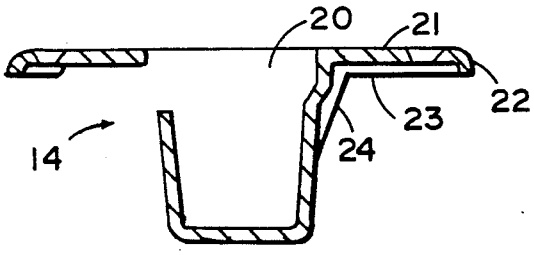
FIG. 4 is a sectional view taken along the plane IV—IV of FIG. 3.

The brackets 13 and 14 each have a circumferential, radially outwardly offset lip 60 forming a vertically shallow, inwardly facing channel 61 at the open end of the socket 20. The sleeves 40 have an external lip 62 at its open end designed to provide peripheral support for the socket wall at its open end. The brackets 13 and 14 each have three openings 63 in their upper side walls. The openings are equally spaced circumferentially of the brackets. Each opening 63 extends from the top the same depth as the channel 61 and has a radial width of sixty degrees. At each opening, the flange 21 is terminated at the point the lip 60 would have joined the flange (FIG. 4).

Figure 5:
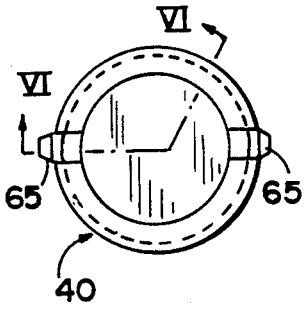
FIG. 5 is a plan view of one of the leg sleeves.
Figure 6:
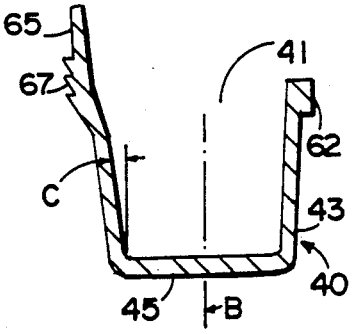
FIG. 6 is a sectional, elevation view taken along the plane VI—VI of FIG. 5.

Each sleeve 40 has a pair of diametrically positioned fingers 65, the outer ends of which project above the top of the sleeve (FIGS. 5 and 6). The opposite ends of the fingers 65 are integral with the sleeve at a point which is aligned with the openings 63 when the sleeve is seated in the socket 20 and, between these ends and the open end of the sleeve, the sides of the fingers are detached from the sleeve.

Figure 7:
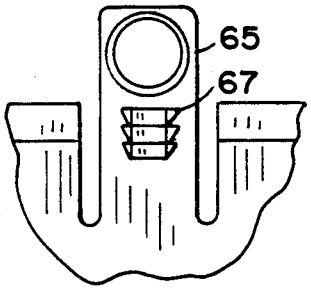
FIG. 7 is an enlarged, fragmentary, elevation view of the latch for securing the leg to one of the brackets.

Each of the fingers 65 has outwardly projecting teeth 67 (FIG. 7) designed to engage under the lower face of the flange 21 and thereby secure the leg from being withdrawn from the socket unless the finger is disengaged from the bracket 13 or 14 (FIG. 2). This is designed to prevent unintentional disengagement of the leg from the socket. The circumferential width of each finger 65 is substantially less than that of one of the openings 63. Because the openings 63 each have a circumferential width of 60° and are equally spaced while the fingers are arranged diametrically, one of the fingers will always latch to a bracket, irrespective of the circumferential position of the leg with respect to the bracket. Thus, a positive lock between the leg and the bracket will always occur when the leg is fully seated in the socket, irrespective of the circumferential position of the leg and sleeve relative to the bracket. This is important because it allows whatever is supported on the leg to be positioned circumferentially, wherever it is most convenient.

The upper or opposite end of the leg is identical to that at the lower end which has just been described. Thus, the upper bracket 13 has the same number and arrangement of openings 63 and the jacket or sleeve 40 has the same pair of diametrically located fingers 65. Again, disengagement between the leg and whatever it is supporting is positively prevented unless the finger 65 which is securing the leg to the bracket is depressed to release it. Once the finger is released, the leg can be detached from the socket in the same manner and with the same ease as the leg described in U.S. Pat. application Ser. No. 325,989.

If the object to be supported is too large to be supported on a single pedestal, two or more of the pedestals incorporating this invention can be utilized. In making this type of installation, it simplifies the task if the lower brackets are first attached to the floor in a pattern suitable to support the object such as a table or a bench. Then, the legs are mounted in the sockets of the floor brackets and the upper brackets mounted on the legs. The table top, bench or other structure can then be placed on the upper brackets properly aligned with the legs and the brackets attached to the table. By this procedure, the necessity for accuracy in locating legs with respect to the floor brackets can be automatically satisfied.

Assuming a single pedestal unit has been in use and is to be removed, the top or other unit supported on the pedestal is rotated and then lifted off the top of the tube. It is at this point that the lubricious surface characteristic of the sleeves is important. This characteristic permits the sliding motion incident to the relative rotational movement between bracket and the sleeve. This is true even though the bracket and sleeve have been forcibly pressed together such as may occur from extended usage or the placing of heavy objects on the surface or several people leaning heavily on the table. If the invention is used with seating, this could result from a person sitting down forcibly. In fact, it has been found that the table, chair or other object mounted on the pedestal or leg can be readily removed simply by lifting vertically without initial rotation. It is for this reason that the invention can be used with units which require plural pedestals.

Once the top has been removed, the leg can be disengaged from the floor bracket by the same procedure, i.e., turning and then lifting out of the lower bracket. Thus, the units can be quickly and easily erected or disassembled for removal. Likewise, the supported unit and the legs with the sleeves attached can be stored very compactly. This is accomplished without sacrifice of stability and dependability. After the legs have been removed, the socket in the lower bracket can be temporarily occupied with a suitable plug of wood or plastic such that no opening will remain to snag a high heel or the like. These plugs are not attached and can be made readily removable when the unit is to be re-erected. To further improve the utility of this invention, the lower or floor brackets can be designed to be fully recessed with their top surfaces flush with the floor.

Of course, it is understood that the above are merely preferred embodiments of the invention and that various other embodiments as well as many changes and alterations can be made without departing from the spirit and broader aspects of the invention as defined in the hereinafter appended claims.

I claim:

1. A detachable pedestal for supporting an object, said pedestal having an elongated rigid leg member and a bracket for securing one end of said leg member to the object; said bracket having a conical socket surrounded by a radially extending supporting flange, said one end of said member having a sleeve of synthetic resinous material bonded thereto and when compressed between the leg and the socket forming a rigid connection between said leg member and socket for supporting the leg against lateral rocking movement when under eccentric loading; said bracket having an opening through the side of said socket extending a minor portion of both the circumference and the depth of the socket, the edge of the socket wall at the end of the opening forming a lip facing toward said socket, said sleeve having a finger integral therewith and extending beyond the leg receiving end of said sleeve, the sides of said finger being separated from said sleeve for a minor portion of the length of said sleeve, said finger having outwardly extending teeth adapted to engage beneath said lip for holding said leg against axial disenagement from said socket.

2. A detachable pedestal for supporting an object as described in claim 1 wherein the radial width of said finger is substantially less than the radial width of said opening through the side of said socket.

3. A detachable pedestal for supporting an object as described in claim 2 wherein a pair of said fingers and a pair of said openings are provided, said fingers and said sockets of each pair being spaced 180° from each other.

4. A detachable pedestal support for an object, said pedestal having an elongated rigid leg member and a bracket for securing one end of said leg member to a supporting surface, said bracket having a peripheral supporting flange and a conical socket substantially centered therein for receiving one end of said leg member, the end of said leg member being surrounded by a sleeve having a conical exterior surface adapted to engage said socket and secure said leg to said bracket, said sleeve having a finger member, one end of which projects beyond the open end of said sleeve and an opposite end integral with the side wall of said sleeve at a point spaced from said open end a minor portion of the depth of said sleeve, said bracket having a radially extending opening in the side wall of said socket at the open end of said socket providing said flange with a radially inwardly facing edge at said socket, said finger member having radially outwardly facing teeth for detachably engaging said edge of said flange for holding said sleeve and leg against separation from said socket axially of said leg.

5. A detachable pedestal support for an object as described in claim 4 wherein the circumferential width of said opening in said side wall is substantially greater than the width of said finger.

6. A detachable pedestal support for an object as described in claim 5 wherein said bracket is provided with three of said openings of equal circumferential length and arranged at equal circumferential spacings.

7. A detachable pedestal support for an object as described in claim 6 wherein each of said openings has a width of 60°.

8. A detachable pedestal support for an object as described in claim 7 wherein said sleeve is provided with a pair of said fingers arranged diametrically of said socket whereby irrespective of the circumferential orientation of said leg and sleeve with respect to said bracket the teeth of one of said fingers will engage the edge of said flange for holding said sleeve and leg against separation from said bracket.

* * * * *